US005406666A

United States Patent [19]

Werlink

[11] Patent Number: 5,406,666

[45] Date of Patent: Apr. 18, 1995

[54] WATER DRIVEN TURBINE/BRUSH PIPE CLEANER

[75] Inventor: Rudy J. Werlink, Winter Springs, Fla.

[73] Assignee: The United States of America as represented by the Administrator of the National Aeronautics and Space Administration, Washington, D.C.

[21] Appl. No.: 207,313

[22] Filed: Mar. 7, 1994

[51] Int. Cl.[6] ..... B08B 9/02

[52] U.S. Cl. ..... 15/104.12; 15/104.31

[58] Field of Search ..... 15/104.09, 104.31, 104.061, 15/104.12, 104.05

[56] References Cited

U.S. PATENT DOCUMENTS

| | | | |
|---|---|---|---|
| 480,653 | 8/1892 | Bell | 15/104.061 |
| 754,955 | 3/1904 | Lemke | 15/104.21 |
| 812,361 | 2/1906 | Pickles et al. | 15/104.061 |
| 1,266,140 | 5/1918 | Montgomery | 15/104.061 |
| 1,641,494 | 9/1927 | Joseph . | |
| 2,201,680 | 5/1940 | Haynes | 15/104.061 |
| 2,576,197 | 11/1951 | Stephens | 15/104.061 |
| 2,735,794 | 2/1956 | Pletcher | 134/24 |
| 3,872,533 | 3/1975 | Proffit | 15/104.12 |
| 4,531,250 | 7/1985 | Watanabe | 15/104.12 |

FOREIGN PATENT DOCUMENTS

| | | | |
|---|---|---|---|
| 13193 | 2/1900 | Sweden | 15/104.061 |
| 21683 | of 1899 | United Kingdom | 15/104.061 |

*Primary Examiner*—Edward L. Roberts, Jr.

*Attorney, Agent, or Firm*—William J. Sheehan; Guy M. Miller; Alan J. Kennedy

[57] ABSTRACT

Assemblies are disclosed for cleaning the inside walls of pipes and tubes. A first embodiment includes a small turbine with angled blades axially mounted on one end of a standoff support. An O-ring for stabilizing the assembly within the pipe is mounted in a groove within the outer ring. A replaceable circular brush is fixedly mounted on the opposite end of the standoff support and can be used for cleaning tubes and pipes of various diameters, lengths and configurations. The turbine, standoff support, and brush spin in unison relative to a hub bearing that is fixedly attached to a wire upstream of the assembly. The nonrotating wire is for retaining the assembly in tension and enabling return of the assembly to the pipe entrance. The assembly is initially placed in the pipe or tube to be cleaned. A pressurized water or solution source is provided at a required flow-rate to propel the assembly through the pipe or tube. The upstream water pressure propels and spins the turbine, standoff support and brush. The rotating brush combined with the solution cleans the inside of the pipe. The solution flows out of the other end of the pipe with the brush rotation controlled by the flow-rate. A second embodiment is similar to the first embodiment but instead includes a circular shaped brush with ring backing mounted in the groove of the exterior ting of the turbine, and also reduces the size of the standoff support or eliminates the standoff support.

7 Claims, 4 Drawing Sheets

WATER DRIVEN TURBINE/BRUSH PIPE CLEANER

This invention relates to pipe and tube cleaners, and in particular to a fluid driven turbine and brush assembly for cleaning the interior of pipes and tubes. The invention described herein was made by an employee of the United States Government and may be manufactured and used by or for the Government for Government purposes without the payment of any royalties thereon or therefor.

BACKGROUND AND PRIOR ART

Pipes and tubing used for transporting fluids such as liquids and gasses often must have their interior walls cleaned because material such as din and scales can buildup on the walls. This buildup constricts the fluid flow and can eventually block the fluid flow entirely. Interior walls of pipes and tubing have been and still are being cleaned by solvent cleaners such as flourinated hydrocarbons (Freon-113). A problem with this solvent is that it is harmful to the ozone layer. Another problem is that Freon is stringently regulated and will be phased out in the future.

Another technique for cleaning the interior of pipes and tubing is by a device that comprises a flexible longitudinal shaft with one end connected to a circular brush and a second end connected to a motor that rotates the shaft for turning the brush. The device is inserted within the tube and pipe. The motor is generally electrically or air driven. A problem with this device is that the tubes and pipes to be cleaned are limited in length to the shaft length. For example, the maximum pipe length is limited by friction of the trailing flex shaft/tube casing on the inside of the pipe. The minimum tubing diameter size is approximately ¾ inch due to the required size of the flex shaft and case. Further, the motor cannot be inserted within the pipes and tubes. Another problem is that the device is inoperable around bends of 90 degrees. An additional problem is that the trailing flexshaft and casing are very difficult to clean and be maintained clean when used. An additional problem is that this device is expensive to operate since it requires power such as electricity and/or shop air to run the motors in addition to a pressurized water or cleaning solution.

SUMMARY OF THE INVENTION

The first objective of the present invention is to provide a method for cleaning tubing and pipes without flourinated hydrocarbons as cleaners.

The second object of this invention is to provide an apparatus for cleaning tubing and pipes that comprise 90 degree bends.

The third object of this invention is to provide an apparatus for cleaning robing and pipes that uses the existing pumped fluid flow through the robing and pipes in order to operate.

The fourth object of this invention is to provide an apparatus for cleaning tubing and pipes that is driven by the regular fluid flowing therethrough.

The fifth object of this invention is to provide an apparatus for cleaning tubing and pipes that can be of variable lengths with or without 90 degree type configurations.

A first embodiment includes an assembly comprising a small turbine with angled blades axially mounted between inner and outer rings, on one end of a standoff support. An O-ring for stabilizing the assembly within the pipe is mounted in a groove within the outer ring. A replaceable circular brush is fixedly mounted on the opposite end of the standoff support and can be used for cleaning robes and pipes of various diameters, lengths and configurations. The turbine, standoff support, and brash spin in unison relative to a hub bearing that is fixedly attached to a wire upstream of the assembly. The nonrotating wire is for retaining the assembly in tension and enabling return of the assembly to the pipe entrance. The assembly is initially placed in the pipe or tube to be cleaned. A pressurized water or solution source is provided at a required flow-rate to propel the assembly through the pipe or tube. The upstream water pressure propels and spins the turbine, standoff support and brush. The rotating brush combined with the solution cleans the inside of the pipe. The solution flows out of the other end of the pipe with the brush rotation controlled by the flow-ram.

A second embodiment is similar to the first embodiment but instead includes a circular shaped brush with ring backing mounted in the groove of the exterior ring of the turbine. In this embodiment, the standoff is not used and the turbine and brush are one assembly.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

First Preferred Embodiment

Figure 1:
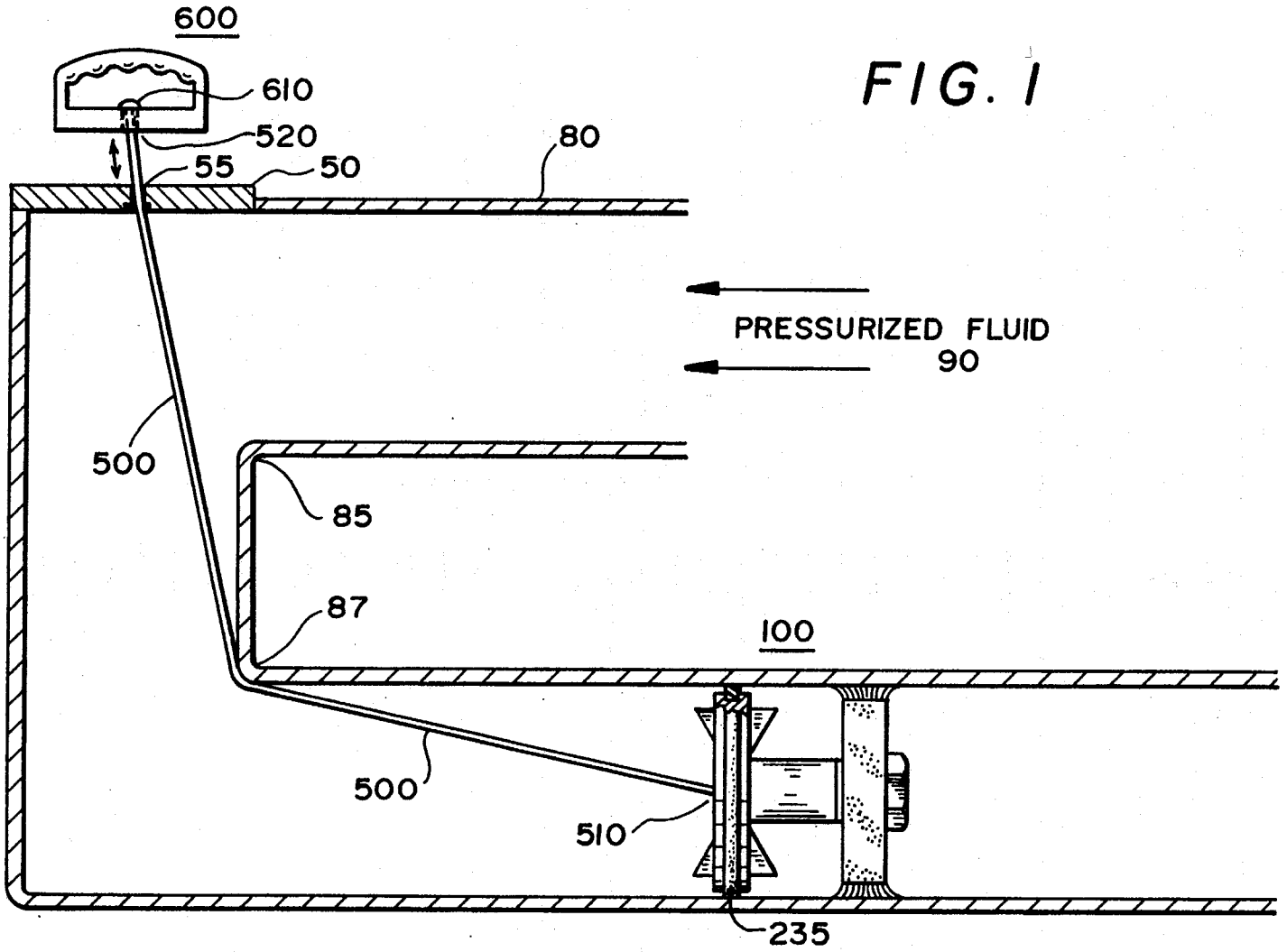
FIG. 1 illustrates a cutaway view of a pressurized fluid pipe with a first preferred cleaning apparatus embodiment in an operating position located therein.

FIG. 1 illustrates an cutaway view of a pressurized fluid pipe 80 with the cleaning apparatus 100 in an operating position located therein. Pressurized fluid 90 such as liquid, gas or liquid oxygen, normally flows through pipe 80. Alternatively, the fluid 90 can be mixed with/or substituted for a cleaning solvent such as a Brullen (water soluble) concentrated cleaning solvent. Apparatus 100 is attached to one end 510 of a flexible guide filament 500 such as 0.0625 inch plastic cable enclosed wire. The second end 520 of the filament 500 is attached to a handgrip 600, which can molded from plastic or configured from stainless steel. Filament end 520 can fit through an opening in the handgrip and held in place at 610 by a screw, bolt or the like. The filament slides through an opening 55 in a capped side 50 of pipe 80. A sealing ring such as an O-ring 56 seals and prevents fluid 90 from leaking out the side of pipe 80.

Figure 2:
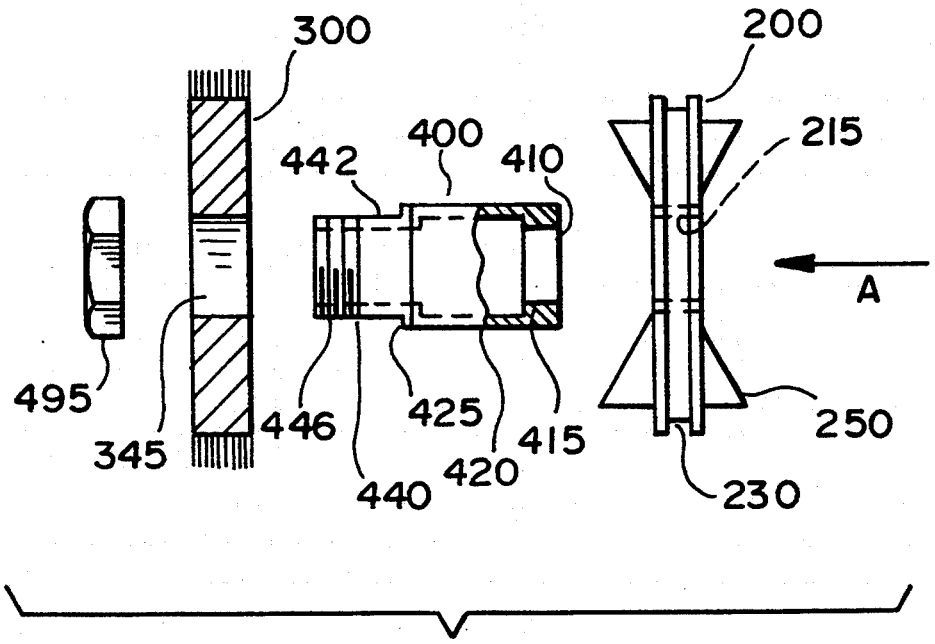
FIG. 2 illustrates an exploded side view of the components within the cleaning apparatus of FIG. 1.

FIG. 2 illustrates a breakaway side view of the cleaning apparatus 100 of FIG. 1, which includes a turbine 200 that abuts up against the top edge 410 on the top end 420 of cylindrical standoff support 400. End 420 has a hollow opening in one end 410 with an internal shoulder portion therein for supporting the outer race 610 shown in FIG. 5. Referring back to FIG. 2, the opposite end of the support 400 includes a extension portion 440 having a narrower diameter than the top end 420. The extension portion 440 includes a smooth surface exterior area 442 for supporting the axial center opening 345 of cylindrical brush 300 of standoff 400. A locking nut 495 has interior threads mateable onto the threaded portion 446. Nut 495 is rotated until brush 300 is fixedly locked in place abutted against edge 425. Circular brush 300 can be a commercially available wheel brush such as part No. MC 4747A63 manufactured by Mac Master-Carr Supply Co. of Atlanta, Ga. The bristles can be nylon, plastic, metal fibers, brass or the like.

Figure 3:
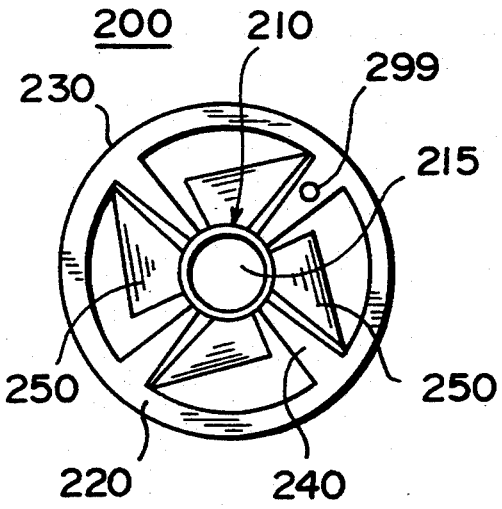
FIG. 3 illustrates a top view of the turbine component of FIG. 2 along arrow A.

FIG. 3 is a top view of the turbine 200 of FIG. 2 along arrow A. Turbine 200 includes inner ring 210 with axial hole 215 sized to frictionally engage the hub bearing 600 shown in FIG. 5. Referring to FIG. 3, turbine 200 includes an outer ring 220 with a groove 230(shown in FIG. 2) for supporting O-ring 235(shown in FIG. 1). The outer ring 220 is connected to the inner ring 210 by legs 240. The diameter of turbine 200 including O-ring 235 has a diameter less than the diameter of the pipes and tubes to be traversed. Between the inner ring 210 and the outer ring 220 are angled blades 250. The angle of the blades are adjustable generally within the range of 20 to 70 degrees depending on the velocity of the fluid flow through the pipe and the desired speed of cleaning apparatus 100. Blades 250 are connected to inner ring 210 by solder such as but not limited to silver solder, welding or the like. Although four blades are shown, any number can be used based on the desired results. The components of the turbine can be machined or cut from stainless steel or the like. An optional permanent magnet 299 formed from Neodymium, such as part no. 5862K51 manufactured by Mac Master-Carr Supply Co. of Atlanta, Ga., can be incorporated into one of the legs 240. Signals from magnet 299 can be monitored by a coil and digital scope that could be located eternally to the pipe or tubing. The magnetic signals can monitor the location and rotational speed of the cleaning apparatus 100.

Figure 4:
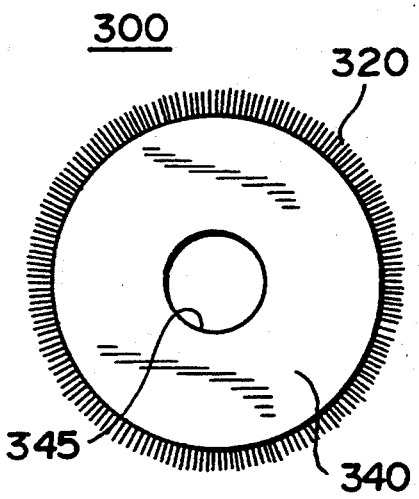
FIG. 4 illustrates a top view of the brush component of FIG. 2 along arrow A.

FIG. 4 is a top view of the brush 300 of FIG. 2 along arrow A. Referring to FIG. 4, brush 300 includes bristles 320 extending outwardly from a circular backing 340. An axial hole 345 is sized to fit over the bottom end portion 440 of the standoff support 400.

Figure 5:
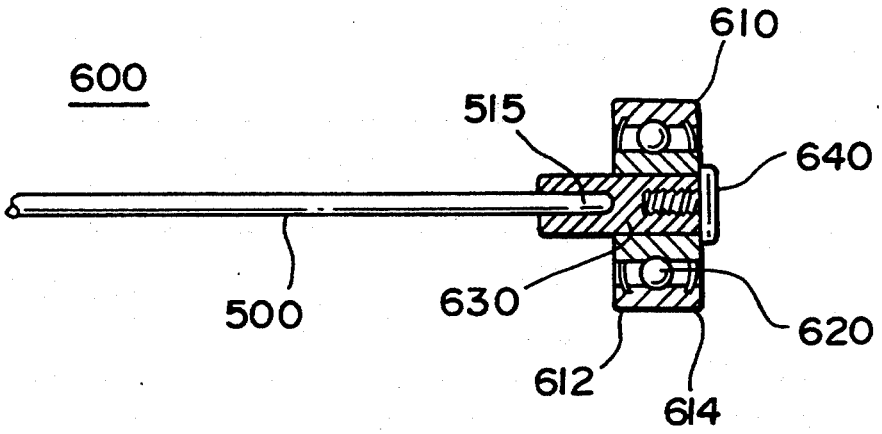
FIG. 5 illustrates a cut away and enlarged side view of the hub bearing and cable connection located within the cleaning assembly of FIG. 1.

FIG. 5 is a cut away and enlarged side view of the hub bearing 600 and cable connection located within the cleaning assembly 100 of FIG. 1. Hub bearing 600 includes a screw 640 for attaching wire 500 to inner race 630 by rotating the screw 640 into ferrule 630. Cable end 515 can be silver soldered or welded to ferrule 630. An outer race 610 is sized along portion 612 to have a tight fit within the hollow top end 420 of standoff support 400 and is prevented from passing through the opening by shoulder 415 shown in FIG. 2. Referring back to FIG. 5, the other portion 614 of outer race 610 is designed to tightly fit within the axial hole 215 of turbine 200. Alternatively race 610 can be soldered or welded to standoff support 400 and/or turbine 200. Bearings 620 allow the outer race along with the turbine 200, standoff support 400 and brush 300 to rotate in unison relative to the ferrule 630 which is fixedly attached to cable end 515.

Figure 6:
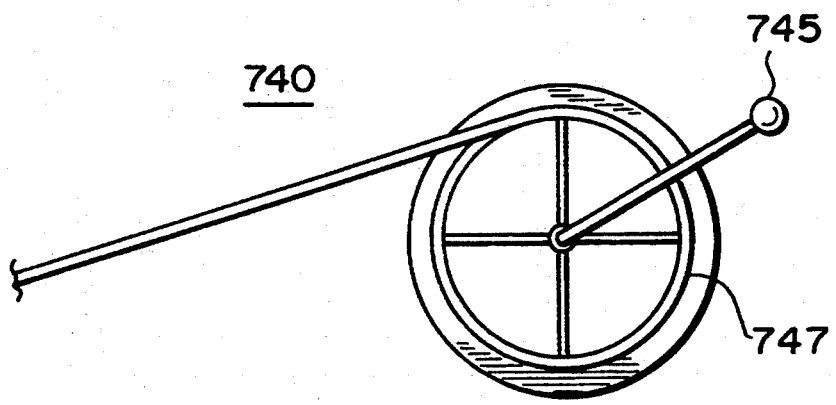
FIG. 6 shows a reel used as an alternative to the handgrip shown in FIG. 1.

FIG. 6 illustrates a reel 740 with spool 747 and crank 745 which can be used as an alternative to the handgrip 600 shown in FIG. 1.

The operation of cleaning apparatus 100 will now be discussed. In reference to FIG. 1, cleaning apparatus 100 is inserted into tube 80 to be cleaned through capped side 50. Handgrip 600 can be raised and lowered to cause apparatus 100 to pass over the interior wall surface areas of pipe 80 that are desired to be cleaned. Unlike the prior art, apparatus 100 can traverse through bends of approximately 90 degrees such position 85. The length of cable 500 is variable in length depending upon the amount of pipe 80 that is to be cleaned.

Referring to FIG. 6, reel 740 can be substituted for handgrip 600 of FIG. 1. Spool 747 allows for using a desired length of cable 500. The crank 745 can be mechanically rotated or remotely actuated.

Second Preferred Embodiment

Figure 7:
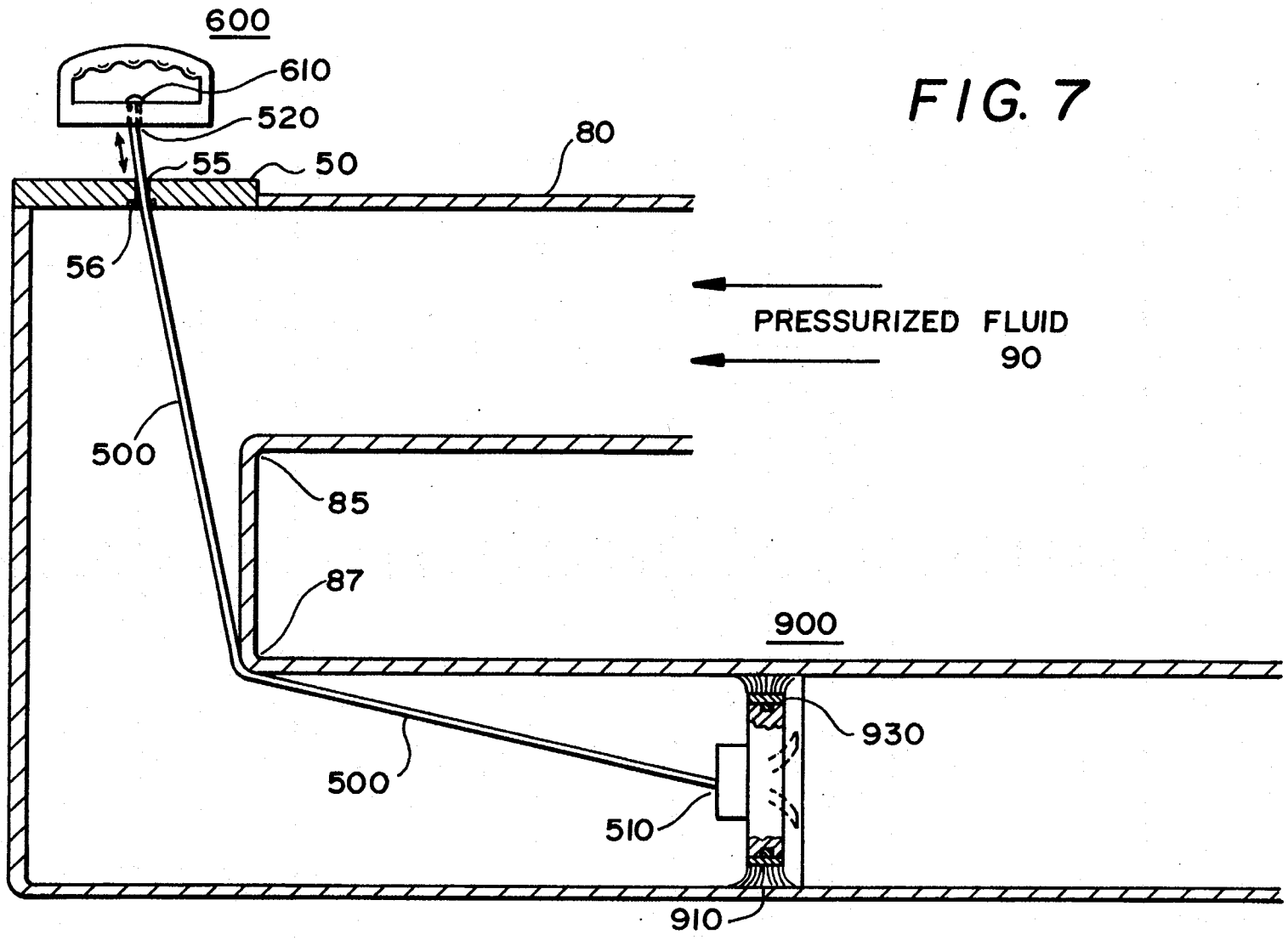
FIG. 7 illustrates a cutaway view of a pressurized fluid pipe with a secondary cleaning apparatus embodiment in an operating position located therein.

FIG. 7 illustrates a cutaway view of a pressurized fluid pipe with a secondary cleaning apparatus embodiment 900 in an operating position located therein. Here cylindrical ringed brush bristles 910 mounted on a ring support 930 can be substituted for the O-ring 235 of FIG. 1. The remaining components and operation of this embodiment is then similar to the first embodiment with the exception that the standoff portion 400 is either not used or is smaller along in length.

Although the embodiments have been described for use within a pipe, this invention is also intended for use within tubes. Further, the location of the cleaning assembly can be monitored by signals such as the magnetic pulses emanating from a magnet attached to the assembly.

The pressurized fluid used to drive the turbine can include liquid such as water and or gas such as air. The material used to make up the components of the cleaning apparatus, handgrip and reel, can be metal such as but not limited to stainless steel, plastic such as but not limited to fiberglass, decomposable plastic materials or combinations thereof.

Although the embodiment described above has been described for use in a commercial setting, the invention can be easily adapted for use in other settings such as for cleaning drain pipes in sinks, bathtubs, showers, toilets, roofs and subterranean storm drain lines.

Although the filament has been described as a cable, the filament can alternatively be composed of wire, kevlar, rope, nylon or combinations thereof having variable tension strengths.

Although, the embodiment disclosed above is described in specific sizes and shapes, the sizes of the components can be varied for cleaning tubes and pipes of various diameters, lengths and configurations. For example, the pipes can be metal such as stainless steel, galvanized steel or aluminum. Alternatively the pipes can be formed from plastic, fiberglass or the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An assembly for cleaning the interior of a pipe having a fluid flow therethrough comprising:

a standoff support having first and second end portions;

a turbine means fixedly attached to said first end portion;

a brush means fixedly attached to said second end portion; and an elongated flexible guide filament having bearing means rotatably mounting one end thereof to said first end portion and said turbine;

said elongated flexible guide filament having its other end extending external of said pipe for guiding said assembly therethrough;

whereby, as fluid flows through said pipe, said standoff support, said turbine and said brush rotate as a unit on said bearing means to clean said interior of said pipe.

2. The cleaning assembly of claim 1, wherein said turbine means includes inner and outer rings connected by supporting legs and angled turbine blades mounted between said inner and outer rings.

3. The cleaning assembly of claim 2, wherein one of said supporting legs includes a permanent magnet means for monitoring the location and speed of said turbine.

4. The cleaning assembly of claim 2, wherein said outer ring further includes a supporting O-ring mounted in a groove.

5. The cleaning assembly of claim 1, wherein said bearing means includes an outer race attached to said turbine.

6. The cleaning assembly of claim 1, wherein said bearing means includes an outer race having portions thereof fixedly mounted within openings provided in said standoff support and said turbine.

7. The cleaning assembly of claim 1, wherein said brush means includes attachment means for selectively removing said brush means from said standoff support.

* * * * *